US008256024B2

(12) United States Patent
Roberts

(10) Patent No.: US 8,256,024 B2
(45) Date of Patent: Sep. 4, 2012

(54) COLD WEATHER GARMENT

(75) Inventor: Jeffrey K. Roberts, Ashland, OR (US)

(73) Assignee: Massif Mountain Gear Company, L.L.C., Asland, OR (US)

( * ) Notice: Subject to any disclaimer, the term of this patent is extended or adjusted under 35 U.S.C. 154(b) by 1414 days.

(21) Appl. No.: 11/842,839

(22) Filed: Aug. 21, 2007

(65) Prior Publication Data

US 2011/0072551 A1 Mar. 31, 2011

(51) Int. Cl.
*A41D 3/00* (2006.01)

(52) U.S. Cl. ..... 2/87; 2/77; 2/84; 2/85; 2/92; 2/93; 2/94; 2/108; 2/115; 2/125

(58) Field of Classification Search ..... 2/77, 84, 2/85, 87, 88, 92, 93, 94, 95, 106, 108, 115, 2/125, 900

See application file for complete search history.

(56) References Cited

U.S. PATENT DOCUMENTS

| | | | | |
|---|---|---|---|---|
| 5,088,116 | A * | 2/1992 | Gould | 2/82 |
| 5,415,924 | A * | 5/1995 | Herlihy, Jr. | 442/35 |
| 5,727,401 | A | 3/1998 | Statham | |
| 6,018,819 | A * | 2/2000 | King et al. | 2/69 |
| 6,892,396 | B2 * | 5/2005 | Uno et al. | 2/115 |
| 7,636,948 | B1 | 12/2009 | Crye et al. | |
| 7,743,476 | B2 * | 6/2010 | Rock et al. | 28/160 |
| 2004/0221360 | A1 * | 11/2004 | Wood et al. | 2/69 |
| 2005/0075028 | A1 * | 4/2005 | Rock et al. | 442/318 |
| 2006/0277651 | A1 | 12/2006 | Razzaghi et al. | |
| 2009/0255038 | A1 * | 10/2009 | Curtis | 2/455 |

OTHER PUBLICATIONS

Crye Precision Combat Shirt, http://cryeprecision.com/product1.asp?P=CS1, 3 pages (Printed Oct. 15, 2007).

http://www.basspro.com/Drake-Waterfowlreg;-Systems-EST-153;-Eqwader-153;-Two-Tone-Pullover-Shirts-for-Men—Long-Sleeve/product/103123/72422?cmCat=CROSSSELL_PRODUCT#description, "Drake Waterfowl® Systems EST™ Egwader™ Two-Tone Pullover Shirts for Men—Long Sleeve," Bass Pro Shops, 2 pgs., retrieved Jan. 27, 2012.

* cited by examiner

*Primary Examiner* — Alissa Tompkins
(74) *Attorney, Agent, or Firm* — Klarquist Sparkman, LLP

(57) ABSTRACT

Described herein are various embodiments of a cold-weather garment. In one exemplary embodiment, a long-sleeve upper-body cold-weather garment includes a torso portion and two sleeve portions that are attached to and extend from opposite edges of the torso portion. The torso portion is made from a first material and the sleeve portions are each made from a second material. The first material is lighter per unit area and more breathable than the second material. The second material is heavier per unit area than the first material, but is more resistant to cold-weather environmental conditions. For example, the second material is water resistant, flame resistant and comprises an outer surface having a camouflage pattern. In some implementations, the second material is made up of at least approximately 50% hydrophobic fibers, includes a coating having water-repellant characteristics, and/or includes a multi-layer composite fabric that includes a water-resistant membrane made from either polyurethane or polytetrafluoroethylene.

18 Claims, 4 Drawing Sheets

COLD WEATHER GARMENT

FIELD

The present application relates to garments, and more particularly, to garments for use in cold weather conditions.

BACKGROUND

People, such as military and law enforcement personnel, involved in cold-weather operations or activities, are best equipped with clothing that provides protection from the environmental elements, such as low temperatures, wind, rain and snow, and protection from other hazards, such as rough terrain, fire, enemy assault, etc. Desirably, such clothing does not interfere with a person's ability to perform required tasks, such as tasks that demand agility and physical exertion.

Conventionally, clothing designed for cold-weather operations, i.e., winter garments, was stiff and bulky, and often interfered with a person's movements. For example, conventional winter garments worn by soldiers in military operations often impeded the soldier's ability to move rapidly, readily access weapons or other equipment, and be comfortable in cramped spaces.

Additionally, some conventional winter garments had other disadvantages. For example, some winter garment designs led to heat stress and exhaustion during activities involving high physical exertion. This is due in part to the insulation and breathability properties of the winter garment. For example, certain conventional winter garment designs have proper insulation and breathability properties for stationary or low-exertion activities, but are overly insulated and/or inadequately breathable for high-exertion activities. Also, some conventional winter garment designs trap moisture during physical activities. Trapped moisture can dampen the winter garment, any underlying garment(s), and the wearer, which increases the risk of cold stress or even hypothermia after completion of such activities.

To avoid at least some of the above shortcomings, a second type of winter garment was designed to breathe, move or wick moisture away from the skin, and keep soldiers warm and relatively dry during periods of exertion. Although the second type of winter garment was an improvement over previous designs, it too had several disadvantages. For example, when worn with other gear or garments, such as body armor vests, the second type of winter garment often provided too much insulation and caused heat stress during physical activities. Personnel such as soldiers commonly don a body armor vest over the torso portion of their winter garments. Although not specifically designed to provide insulation, body armor vests provide a latent insulation to the torso, or core, portion of the body. Because the second type of winter garment was designed to provide equal amounts of insulation on the torso and sleeve portions of the garment, the garment did not take into account the extra insulation afforded by the armor. In other words, a user wearing both the second type of winter garment and a body armor vest was often overly insulated about his or her torso, which often negatively affected the user's core temperature and increased the risk of heat stress.

One solution to over-insulating the torso is to forgo wearing a winter garment. Although the body armor would provide some insulation and protection from the elements on the torso, the soldier's arms would be exposed to the elements. Therefore, to provide adequate insulation and protection of the torso and arms in cold weather conditions, a soldier is provided with few options other than wearing the second type of winter garment and body armor vest together, and risking over-insulating, and thus overheating, the core of the body.

Another shortcoming of known winter garments, as well as many warm weather or summer garments, is a lack of adequate protection from flame hazards. Flame hazards exist in many varieties and situations for a variety of personnel, such as, for example, soldiers encountering roadside or suicide bombs, or positioned at high profile targets, as well as aviators, fuel handlers and combat vehicle crewman engaged in various activities. Typically, garments designed to provide flame resistance often sacrifice certain desirable characteristics, such as comfort, functionality, breathability, stretchability, and compactness, for protection.

SUMMARY

Described herein are various embodiments of a flame-resistant, cold-weather garment that provides improved body temperature regulation when worn under body armor during cold-weather applications as compared to conventional garments.

Improper core and extremity temperature regulation can lead to heat or cold stress on the body, which can negatively affect cognitive decision-making skills and physical capabilities. In terms of a soldier's performance in a military operation, improper temperature regulation can threaten the success of a mission. Accordingly, proper regulation of the core and extremity temperatures of soldiers can provide a tactical advantage for troops involved in a wide variety of field operations.

To achieve these and other advantages, the cold-weather garment described herein assists in maintaining the core and extremity temperatures of wearers at a comfortable and proper level in cold weather conditions. Generally, in certain implementations, the cold-weather garment is at least partially waterproof, windproof and/or breathable to maintain proper body temperature regulation. Moreover, in some implementations, the cold-weather garment described herein can provide flame-resistance in cold weather conditions. Additionally, according to some implementations, the cold-weather garment described herein can resist abrasion in cold weather conditions.

More specifically, in one exemplary embodiment, a long-sleeve upper-body cold-weather garment includes a torso portion and two sleeve portions that are attached to and extend from opposite edges of the torso portion. The torso portion is made from a first material and the sleeve portions are each made from a second material. The first material is lighter per unit area and more breathable than the second material. The second material is heavier per unit area than the first material, but is more resistant to cold-weather environmental conditions. For example, the second material is water resistant, flame resistant and comprises an outer surface having a camouflage pattern. In some implementations, the second material is made up of at least approximately 50% hydrophobic fibers, includes a coating having water-repellant characteristics, and/or includes a multi-layer composite fabric that includes a water-resistant membrane made from either polyurethane or polytetrafluoroethylene.

In some implementations, the first material includes a single layer made of one material and the second material includes three layers each of a different material. The first layer consists essentially of a woven or knitted face fabric and comprises the outer surface. The second layer consists essentially of a single-side-pile knitted fleece fabric. The third layer is positioned between the first and second layer and consists essentially of a water-resistant membrane.

According to some implementations, the second material includes a single-side-pile or double-side-pile knitted fleece fabric that is made of at least approximately 50% hydrophobic yarns. In some implementations, the first material is flame resistant. In some implementations, the first material includes a non-pile, non-fleece fabric.

According to certain aspects, the torso portion includes two armpit sections. In other aspects, each sleeve portion includes an armpit section. In some aspects, each sleeve portion includes a respective shoulder section. However, in other implementations, the torso portion includes right and left shoulder sections. Also, in some implementations, the torso portion includes a front and back torso section and each sleeve portion includes a respective one of a right and left side torso section. The garment can, in some implementations, include a collar portion made essentially from the second material. In other implementations, the collar portion can be made essentially from the first material.

According to another embodiment, an upper-body cold-weather garment includes a torso portion, two long-sleeve portions and a collar portion. The torso portion is primarily made from a first material having a first weight per unit area and a first breathability rating. The long-sleeve portions extend from the torso portion and is primarily made from a second material having a second weight per unit area greater than the first weight per unit area and a second breathability rating lower than the first breathability rating. The collar portion is positioned proximate an upper end of the torso portion and is primarily made from the second material. The second material includes (i) an insulation and flame-resistant inner layer made of a single-side-pile knitted fleece, (ii) an abrasion-resistant outer layer made of a woven or knitted face fabric, and (iii) a waterproof and windproof intermediate layer between the inner and outer layers made of a polymeric material.

According to some implementations, the collar portion includes an adjustable placket. In certain implementations, the outer layer includes a water repelling coating. In yet certain implementations, the inner layer is made of at least approximately 50% hydrophobic fibers. In certain implementation, the inner layer is made of a single-side-pile or double-side-pile knitted fleece fabric. The two long-sleeve portions can, in some implementations, each include a shoulder section that extends from the collar portion.

According to another exemplary embodiment, a cold-weather and projectile protection system includes a long-sleeve upper-body garment and a body armor vest. The garment includes a torso portion that includes a first material with a first weight per unit area and a first breathability rating. The garment also includes two long-sleeve portions that extend from the torso portion. Each long-sleeve portion has a shoulder section and includes a second material having a second weight per unit area greater than the first weight per unit area and a second breathability rating lower than the first breathability rating. The second material includes an insulation and flame-resistant inner layer that includes a single-side-pile knitted fleece, an abrasion-resistant outer layer that includes a woven or knitted face fabric, and a waterproof and windproof intermediate layer between the inner and outer layers that includes a polymeric material. The body armor vest is wearable over the long-sleeve upper-body garment and provides protection against projectiles, such that when worn, the vest substantially covers the torso portion of the garment and does not substantially cover the long-sleeve portions of the garment.

The foregoing and other features and advantages of the cold-weather garment will become more apparent from the following detailed description, which proceeds with reference to the accompanying figures.

DETAILED DESCRIPTION

Figure 1:
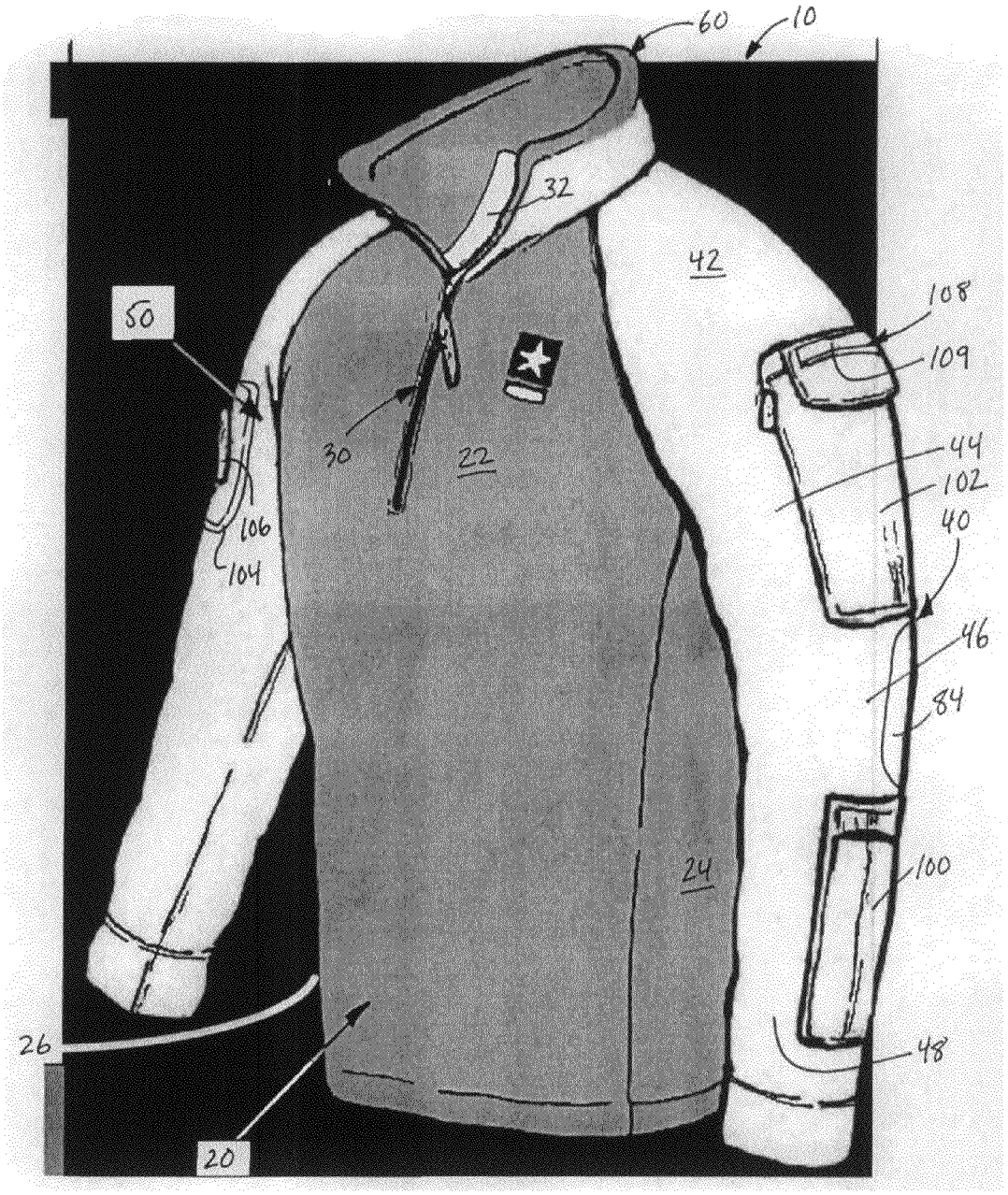
FIG. 1 is a perspective view of a cold-weather garment according to one embodiment.

Referring to FIG. 1, one embodiment of a cold-weather, e.g., winter, garment 10 is shown. The garment 10 includes a torso portion 20 and two long sleeve portions, i.e., a left sleeve portion 40 and a right sleeve portion 50, coupled to and extending from the torso portion. In certain implementations, the garment 10 also includes a collar portion 60 coupled to the torso portion 20 at its upper end near the neck of the wearer and intermediate the left and right sleeve portions 40, 50. The torso portion 20 is made from a first material and the left and right sleeve portions 40, 50 are made from a second material (see FIG. 2) different than the first material. In implementations having the collar portion 60, the collar portion can be made from either the first or second material.

The respective portions of the cold-weather garment 10 are attached to each other via any of various fabric coupling techniques to form a seam along the intersection of two or more portions. In one exemplary implementation, the seam is formed using any of various known fabric coupling techniques, such as by using flame-resistant thread.

Figure 3:
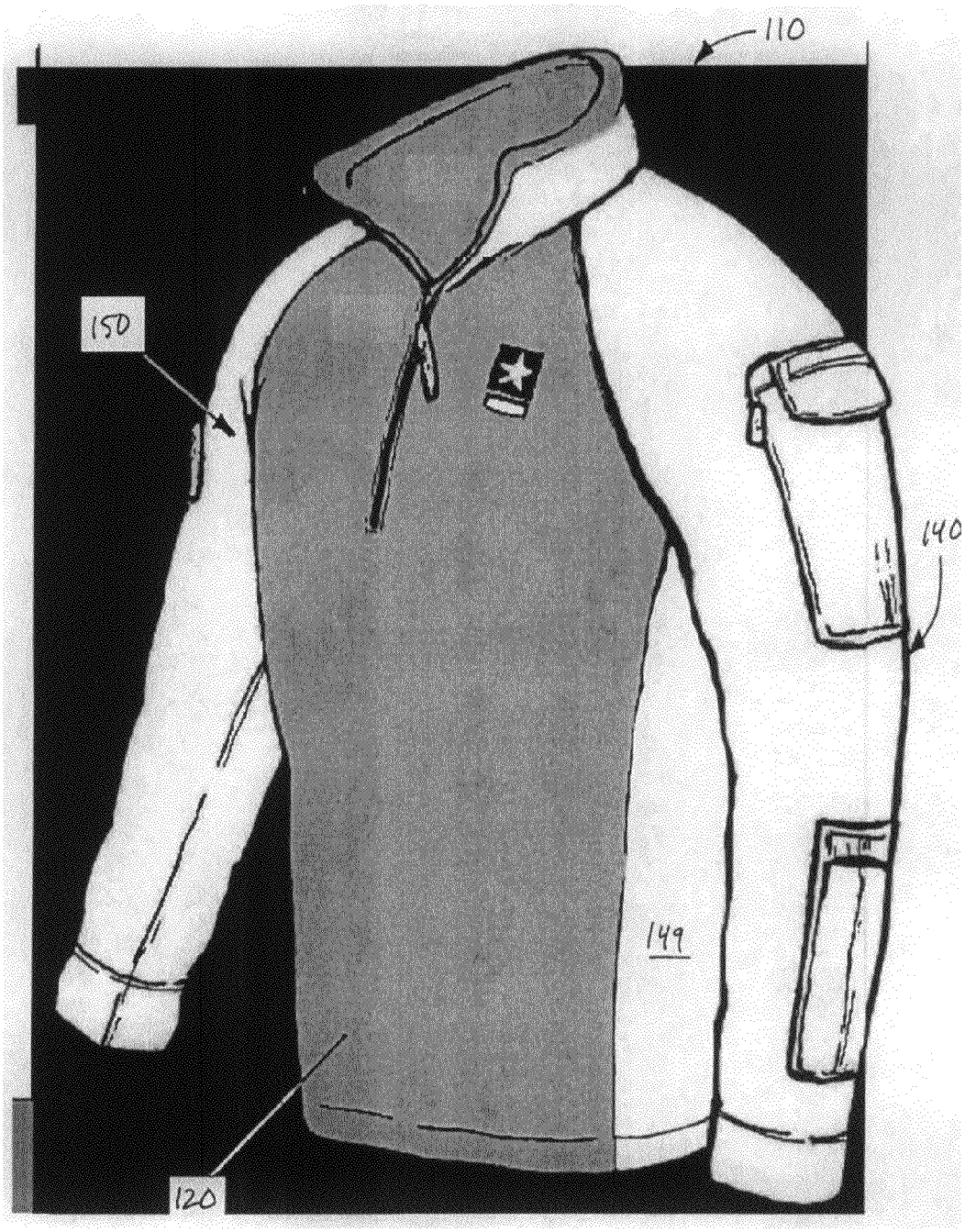
FIG. 3 is a perspective view of a cold-weather garment according to another embodiment.

According to the embodiment shown in FIG. 1, when the garment 10 is properly worn by a wearer, the torso portion 20 includes a front section 22 that substantially covers the chest and abdomen area of the wearer, left and right side sections 24, 26 that substantially cover the left and right sides of the wearer's torso below the arms, respectively, and a back section (not shown) that substantially covers the back of the wearer. However, in other embodiments, such as shown in FIG. 3, the torso portion 120 of garment 110 does not include left and right side sections and does not cover the left and right sides of the wearer's torso below the arms. In some implementations, the torso portion 20 of garment 10 also covers the left and right armpit areas of the wearer. The torso portion 20 can be made from one continuous piece of fabric or several interconnected pieces of fabric.

In some embodiments, the torso portion 20 includes a placket, e.g. slit, 30 formed in the collar portion 60 and front section 22 of the torso portion 20. In some instances, the placket 30 extends along the entire length of the front section 22 and in other instances, such as shown in FIG. 1, the placket extends along only a portion of the front section 22. The placket 30 can be adjusted between a fully open and fully closed position by any of various coupling mechanisms, such as, for example, zippers, hook and loop fasteners, string, buttons, snaps, other closures, etc., to provide a desired level of venting depending on any of various factors, such as the environmental conditions and comfort of the wearer. In one implementation, the coupling mechanism is a zipper made from a flame-resistant resin. In some embodiments, the placket 30 includes a flap 32 that at least partially underlies, and in some implementations, overlies, the seam formed between opposing sides of the placket when the placket is at least partially closed. The flap can be made from any of various materials, but preferably is made from the second material.

Although not shown, the cold-weather garment 10 can include adjustable collar openings and lower torso openings to provide further adjustability of the level of venting and, in some cases, the garment's fit. For example, the collar portion 60 and lower section of the torso portion 20 can include embedded resiliently elastic cords at least partially enveloping the respective openings. The cords can be tightened to effectively decrease the circumference of the openings to decrease venting through the openings, or loosened to effectively increase the circumference of the openings to increase venting through the openings.

The right sleeve portion 50 includes the same or similar features as the left sleeve portion 40. Accordingly, unless otherwise noted, the details of the right sleeve portion 50 can be recognized with reference to the following features of the left sleeve portion 40. In the embodiment shown in FIG. 1, when the garment 10 is properly worn by a wearer, the left sleeve portion 40 includes a shoulder section 42 that covers the left shoulder of the wearer, an upper arm section 44 that covers the upper left arm of the wearer, an elbow section 46 that covers the elbow of the wearer, and a lower arm section 48 that covers the lower left arm of the wearer. In other embodiments, such as shown in FIG. 3, the left and right sleeve portions 140, 150 of the garment 110 include left and right side sections, such as left side section 149, that cover the left and right sides of the user's torso when the garment 10 is properly worn. The shoulder section 42 of the garment 10 are preferably seamless to reduce wear on the body armor and person's body, which often results from seams rubbing against the armor. In some implementations, the left sleeve portion 40 covers the left armpit area of the wearer, and in other implementations, the left sleeve portion does not cover the left armpit area of the wearer to allow for extra breathability in the armpit area.

Figure 4:
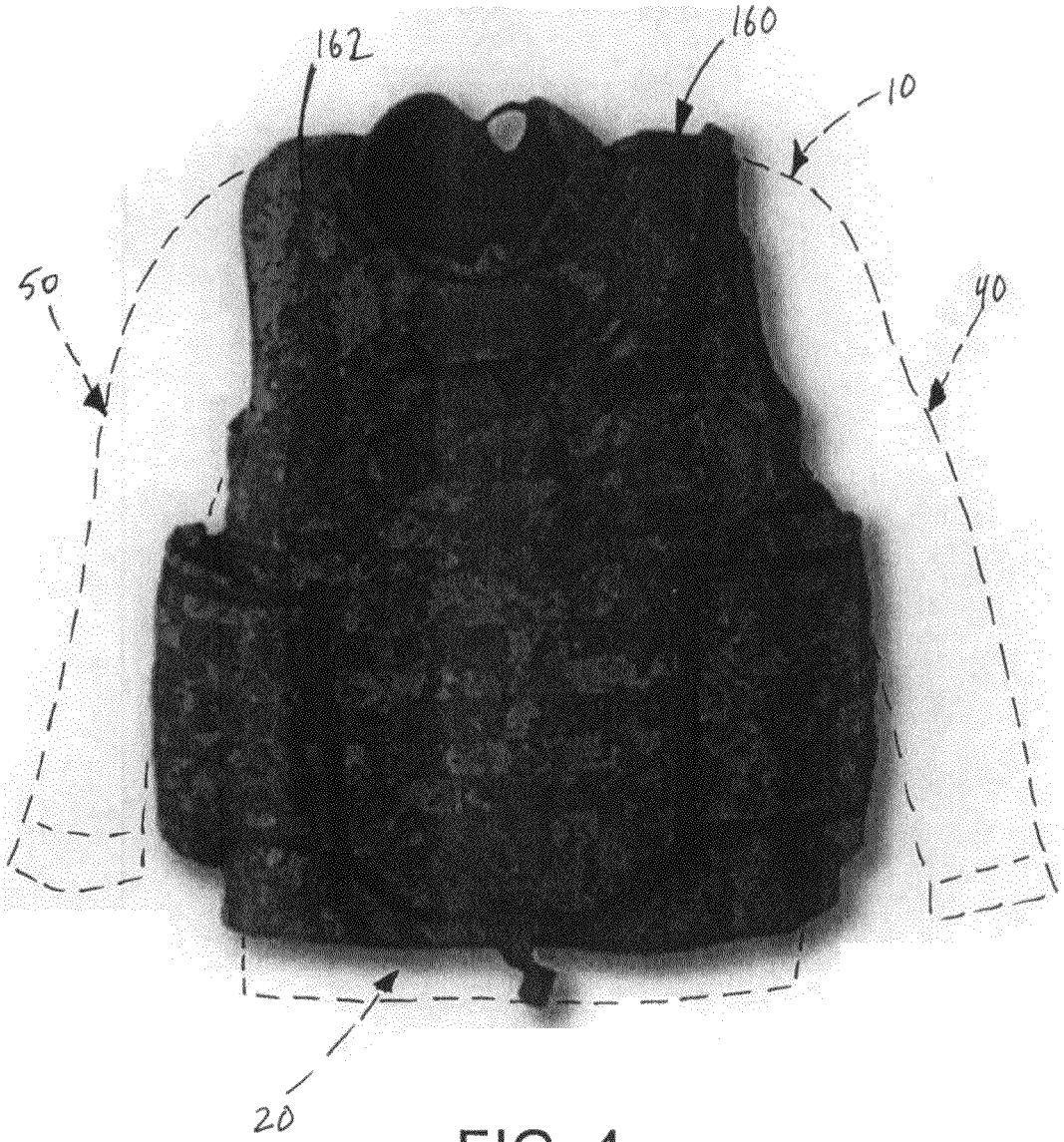
FIG. 4 is a front view of a body armor vest according to one exemplary embodiment worn over the cold-weather garment of FIG. 1.

As described above, the torso portion 20 is made from a first material and the left sleeve portion 40 is made from a second material. Generally, the first material is lighter per unit area and provides more breathability than the second material. However, the second material provides better protection from environmental elements than the first material. For example, in some implementations, the second material provides more insulation, better flame-resistance, better waterproofing, better windproofing and/or better wear resistance than the first material. Unlike conventional winter garments where the torso and sleeve portions both are made of materials that have the same or similar levels of water-resistance, in some implementations, the first material of the torso portion 20 has minimal water-resistance and the second material of the sleeve portion 40 has significant water-resistance. As shown in FIG. 4, for a user wearing a body armor vest 160 over the cold-weather garment 10, the cold-weather garment provides greater protection and more insulation of the user's upper body not covered by the vest, e.g., the left and right arms covered by the left and right sleeve portions 40, 50, and less insulation and bulk about the user's body covered by the vest, e.g., the torso covered by the torso portion 20. Moreover, although gaps may exist between the vest 160 and the cold-weather garment 10, such as around the neck, shoulder and armpit areas, applicant discovered that the material composition and bulk of the vest can provide significant water-resistance for a torso portion 20 (including areas adjacent the gaps) made of a minimally water-resistant material.

The garment 10 can be used in conjunction with any of various commercially available body armor vests, such as Interceptor Body Armor made by Point Blank Body Armor, Inc. Typically, a body armor vest, such as vest 160, includes an outer tactical vest portion 162 and front and back protective inserts or plates that are supported by the vest portion. Some body armor vests also include right and left side protective inserts that are supported by the vest. Preferably, the body armor vest is sleeveless, such as body armor vest 160. However, in some implementations, a body armor vest having sleeves can be worn over the garment 10.

In certain embodiments, the first material is a single layer of lightweight, soft, breathable, flame-resistant and stretchable material, such as a 4-way stretchable, 2-end or 3-end knit fleece fabric, e.g., Flamestretch™ fleece fabric made by Massif Mountain Gear Company, or other fleece fabric, such as described in U.S. Pat. No. 5,727,401, which is incorporated herein by reference. In exemplary implementations, the first material is a single-side-pile or double-side-pile knitted fleece fabric. At least half of the fleece fabric can be made from one type of combination of hydrophobic fibers, such as, but not limited to, polyester, nylon, acrylic, modacrylic and aramid. As defined herein, hydrophobic materials, such as fibers and yarns, are materials that exhibit a moisture regain of less than 4.8%. In other implementations, the first material is a non-pile, non-fleece knit fabric, such as, but not limited to, a jersey or interlock knit fabric having a finished fabric weight between approximately 6.9 and 10.9 ounces per square yard.

The first material is more breathable that the second material according to the ASTM D 737 Air Permeability Test. For example, in one exemplary implementation, the first material can have a breathability rating of approximately 143 $ft^3/min/ft^2$ or more and the second material can have a breathability rating of approximately 0.562 $ft^3/min/ft^2$ or less. In several implementations, the first material is also flame-resistant. As defined herein, a flame-resistant material is a material that has less than approximately 6.0 seconds afterflame and exhibits no melting or dripping when tested according to the ASTM D 6413 Flame Resistance of Textiles Vertical Test.

According to certain embodiments, the second material includes multiple laminated or non-laminated material layers. For example, referring to FIG. 2, in one specific exemplary implementation, the second material can include a first inner layer 70, a second outer layer 80, and a third intermediate layer 90 between the inner and outer layers.

The first inner layer 70 is a single-side-pile knitted fleece fabric made of one or more types of hydrophobic fibers, such as, but not limited to, polyester, nylon, acrylic, modacrylic and aramid. In some instances, at least 50% of the first inner layer is made of hydrophobic fibers. Accordingly, the first inner layer can provide water-resistance characteristics.

Figure 2:
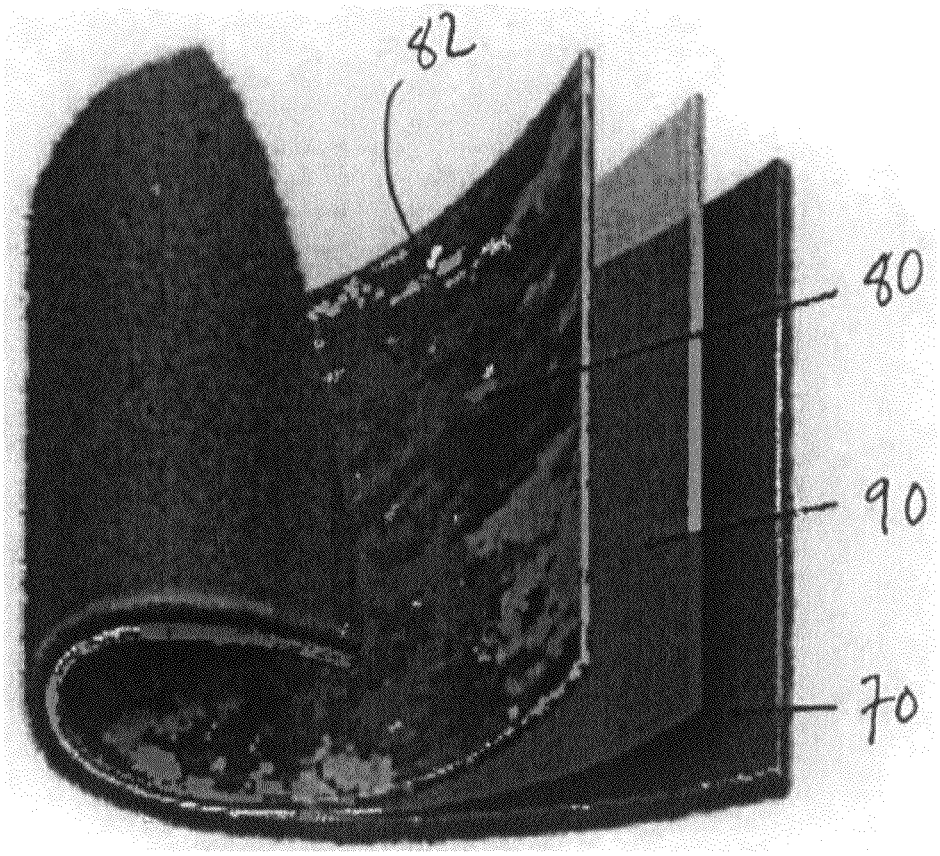
FIG. 2 is an exploded cross-sectional view of a sleeve portion of the cold-weather garment of FIG. 1.

The second outer layer 80 is a woven or knitted face fabric providing a relatively high resistance to abrasion, e.g., exhibiting approximately 1,000 or more cycles before wear-through when tested according to the ASTM D 3884 Abrasion Resistance Test with CS 10 abrasive wheels and a 250 gram load. In some implementations, the second outer layer includes a knit jersey fabric having a weight of approximately 5.9 to 7.8 ounces per square yard and being primarily made from an aramid fiber blend. As shown in FIG. 2, the second outer layer can include a camouflage pattern, such as a conventional camouflage pattern or a digital camouflage pattern 82 as illustrated.

The third intermediate layer 90 is a water-resistant, waterproof and/or windproof membrane. In some implementations, the membrane is made from polyurethane or polytetrafluoroethylene having any of various thicknesses.

In some embodiments, in addition to or instead of the third intermediate layer, the second material can include a water-repellent coating or encapsulated finish to one or more of the first inner layer and second outer layer. The coating and finish, respectively, repel moisture and wind to help regulate the body temperature and comfort of the wearer. Also, in some implementations, the three layers are bonded together, such as through use of an adhesive or glue.

The second material can also have flame-resistance properties. For example, like the first material, the first inner layer 70 can be made of a fabric having less than approximately 6.0 seconds afterflame and exhibiting no melting or dripping when tested according to the ASTM D 6413 Flame Resistance of Textiles Vertical Test. Alternatively, or in addition to a flame-resistant first inner layer 70, one or more of the layers of the second material can be treated with a flame suppressant chemical, such as any of various flame suppressant chemicals known in the art.

In certain embodiments, respective elbow assemblies 84 are attached to the second outer layer of the left and right sleeve portions 40, 50 over the wearer's elbow. Each elbow assembly can include a lightweight flame-resistant pad, such as a foam pad. In some implementations, each elbow assembly includes a series of relatively small outwardly extending protrusions, such as abrasion dots, for wear resistance. Also, in some embodiments, the cold-weather garment 10 can also include one or more storage pockets, tool holders and insignia holders attached to, or integrated in, the outer surface of the garment. For example, in one implementation, the cold-weather garment 10 includes a pen pocket 100 attached to the outer surface of the left sleeve portion 40, storage pockets 102, 104 attached to the outer surface of the left and right sleeve portions 40, 50, respectively, and an insignia holder 106, such as a flag holder, attached to the outer surface of the right sleeve portion 50.

For security and tracking purposes, the cold-weather garment 10 can also include one or more infrared identification assemblies, such as infrared identification assembly 140 secured to the left sleeve portion 40. The infrared identification assembly 108 includes an infrared beam reflector (not shown) coverable by a removable cover 109.

In view of the many possible embodiments to which the principles of the disclosed cold-weather garment may be applied, it should be recognized that the illustrated embodiments are only preferred examples and should not be taken as limiting the scope of the garment. Rather, the scope of the invention is defined by the following claims. We therefore claim as our invention all that comes within the scope and spirit of these claims.

I claim:

1. A long-sleeve upper-body cold-weather garment, comprising:

a torso portion consisting of a first material selected to provide moisture management having a first weight per unit area and a first breathability rating; and two sleeves attached to and extending from opposite edges of the torso portion, the two sleeves consisting of a second material having a second weight per unit area greater than the first weight per unit area and a second breathability rating lower than the first breathability rating;

wherein the second material:

(i) is a multi-layer, water-resistant composite fabric comprising a first layer consisting of a woven or knitted face fabric, the first layer comprising the outer surface resistant to abrasion and having a camouflage pattern, a second layer consisting of a single-side knitted fleece fabric and a third layer between the first and second layers, the third layer consisting of a water-resistant membrane comprised of polyurethane or polytetrafluoroethylene; and (ii) is flame resistant.

2. The garment of claim 1, wherein the second material comprises a single-side or double-side knitted fleece fabric comprised of at least approximately 50% hydrophobic yarns.

3. The garment of claim 1, wherein the first material is flame resistant.

4. The garment of claim 1, wherein the first material is comprised of a non-pile, non-fleece fabric.

5. The garment of claim 1, wherein each sleeve portion comprises an armpit section.

6. The garment of claim 1, further comprising a collar, wherein each sleeve portion is attached to the collar.

7. The garment of claim 1, wherein each sleeve portion comprises a respective shoulder section.

8. The garment of claim 1, wherein the torso portion comprises a front torso section and a back torso section.

9. The garment of claim 1, wherein the torso portion comprises right and left side sections.

10. The garment of claim 1, further comprising a collar portion consisting essentially of the second material.

11. The garment of claim 1, further comprising a collar portion consisting essentially of the first material.

12. An upper-body cold-weather garment, comprising:

a torso portion consisting of a first material having a first weight per unit area and a first breathability rating;

two sleeves extending from the torso portion, the sleeves consisting of a second material having a second weight per unit area greater than the first weight per unit area and a second breathability rating lower than the first breathability rating; and a collar portion proximate an upper end of the torso portion and consisting of the second material;

wherein the second material comprises (i) an insulation and flame-resistant inner layer consisting of a single-side knitted fleece, (ii) an abrasion-resistant outer layer consisting of a woven or knitted face fabric, and (iii) a waterproof and windproof intermediate layer between the inner and outer layers consisting of a polymeric material.

13. The garment of claim 12, wherein the collar portion comprises an adjustable placket.

14. The garment of claim 12, wherein the outer layer comprises a water repelling coating.

15. The garment of claim 12, wherein the inner layer is comprised of at least approximately 50% hydrophobic fibers.

16. The garment of claim 12, wherein the inner layer is comprised of a single-side or double-side knitted fleece fabric.

17. The garment of claim 12, wherein the each of the two sleeves comprises a shoulder section extending from the collar portion.

18. A cold-weather and projectile protection system, comprising:

a long-sleeve upper-body garment comprising (i) a torso portion consisting of a first material having a first weight per unit area and a first breathability rating and (ii) two sleeves extending from the torso portion and each having a shoulder section, the two sleeves consisting of a second material having a second weight per unit area greater than the first weight per unit area and a second breathability rating lower than the first breathability rating, wherein the second material comprises an insulation and flame-resistant inner layer consisting of a single-side knitted fleece, an abrasion-resistant outer layer consisting of a woven or knitted face fabric, and a waterproof and windproof intermediate layer between the inner and outer layers consisting of a polymeric material; and a body armor vest wearable over the long-sleeve upper-body garment and providing protection against projectiles, wherein when worn, the vest substantially covers the torso portion of the garment and does not substantially cover the sleeves of the garment.

* * * * *